US005839409A

United States Patent [19]

Denz et al.

[11] Patent Number: 5,839,409

[45] Date of Patent: Nov. 24, 1998

[54] PROCESS FOR FINDING AN ADDITIONAL QUANTITY OF FUEL TO BE INJECTED DURING REINJECTION IN AN INTERNAL COMBUSTION ENGINE

[75] Inventors: Helmut Denz, Stuttgart; Manfred Pfitz, Vaihingen; Klaus Böttcher, Oberriexingen; Alfred Kloos, Weissach, all of Germany

[73] Assignee: Robert Bosch GmbH, Stuttgart, Germany

[21] Appl. No.: 930,889

[22] PCT Filed: Dec. 18, 1996

[86] PCT No.: PCT/DE96/02448

§ 371 Date: Oct. 6, 1997

§ 102(e) Date: Oct. 6, 1997

[87] PCT Pub. No.: WO97/29276

PCT Pub. Date: Aug. 14, 1997

[30] Foreign Application Priority Data

Feb. 6, 1996 [DE] Germany ..... 196 04 136.8

[51] Int. Cl.[6] ..... F02D 41/12

[52] U.S. Cl. ..... 123/326; 123/481; 123/493

[58] Field of Search ..... 123/325, 326, 123/481, 492, 493

[56] References Cited

U.S. PATENT DOCUMENTS

| | | | |
|---|---|---|---|
| 4,452,212 | 6/1984 | Takase | 123/326 X |
| 4,896,644 | 1/1990 | Kato | 123/492 |
| 4,919,094 | 4/1990 | Manaka et al. | 123/326 |
| 5,065,716 | 11/1991 | Nakagawa et al. | 123/326 |
| 5,611,315 | 3/1997 | Dohta et al. | 123/492 |
| 5,669,357 | 9/1997 | Denz et al. | 123/481 |

*Primary Examiner*—Tony M. Argenbright
*Attorney, Agent, or Firm*—Kenyon & Kenyon

[57] ABSTRACT

A method for determining an additional injected quantity upon reactivation of an internal combustion engine by multiplying a load-dependent wall-film quantity by a correction factor. The correction factor is modulated up during the coasting deactivation time until reactivation with a first time constant. The correction factor is modulated back down during reactivation with a second time constant.

5 Claims, 1 Drawing Sheet

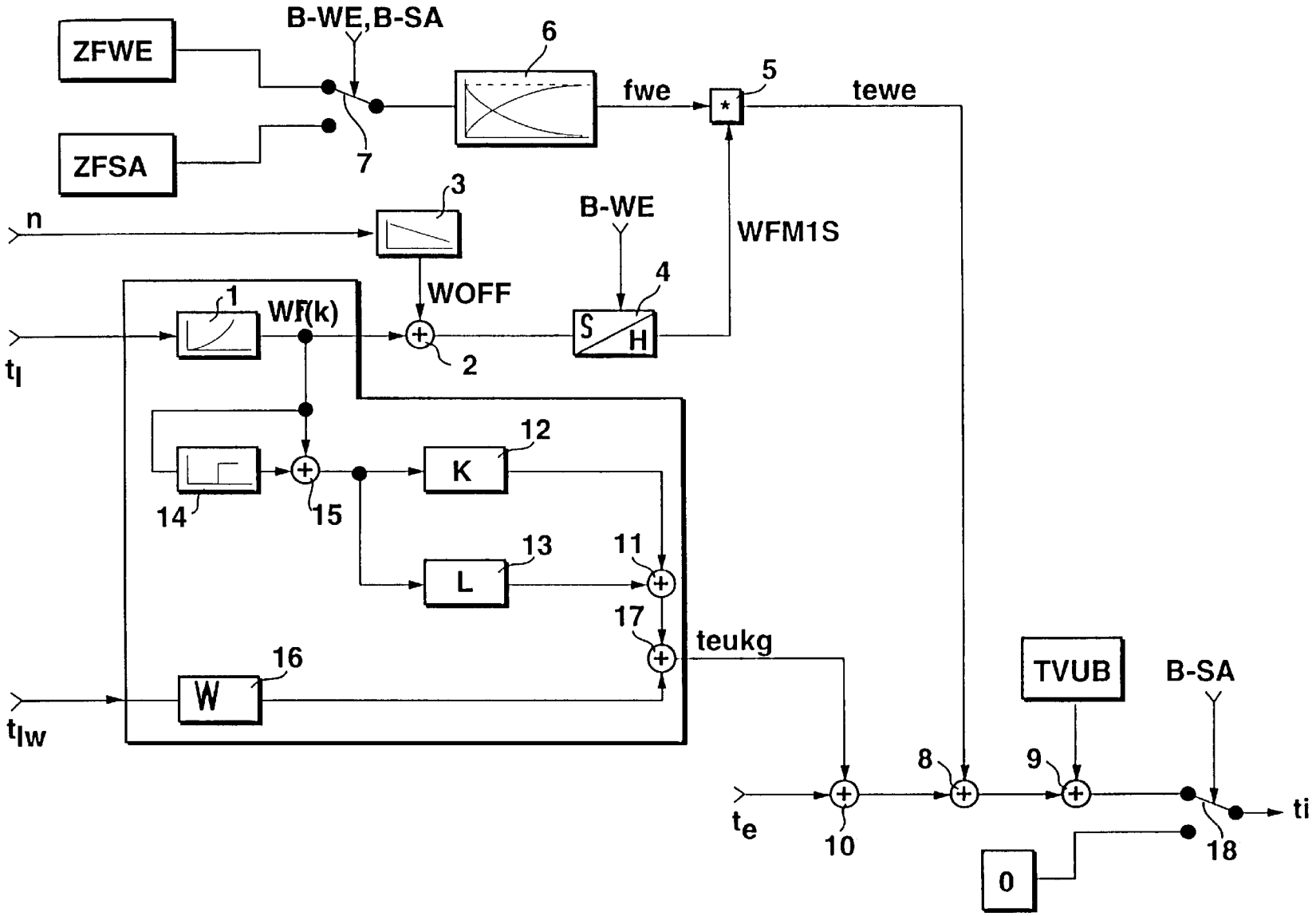
ZFWE
ZFSA
B-WE,B-SA
7
6
fwe
5
tewe
n
3
WOFF
2
WFM1S
B-WE
4
S
H
WF(k)
1
$t_I$
K
12
L
13
15
14
11
17
teukg
16
W
$t_{IW}$
$t_e$
10
8
9
TVUB
B-SA
18
ti
0

PROCESS FOR FINDING AN ADDITIONAL QUANTITY OF FUEL TO BE INJECTED DURING REINJECTION IN AN INTERNAL COMBUSTION ENGINE

BACKGROUND INFORMATION

German Patent Application No. DE 43 28 835 A1 describes a method that determines an additional injected quantity on a cylinder-selective basis after reactivation following injection suppression operations for individual cylinders. Examples of suppression operations include automatic slip control (ASR), deactivation while coasting, or an engine speed or vehicle speed limiter. In this context, the initial value upon reactivation of fuel delivery depends on the number of injections that were suppressed to the cylinder in question. After reactivation, the additional injected quantity is modulated back down to zero, as a function of the number of injections into the cylinder in question after suppression thereof was ended. The additional injected quantity required at the time of reactivation is based on a permanently predefined injection value that is modulated up with a certain time constant.

It is the object of the present invention to indicate a method for determining an additional injected quantity upon reactivation of at least one suppressed cylinder of an internal combustion engine which improves emissions and fuel consumption values as compared to the existing art.

SUMMARY OF THE INVENTION

The present invention provides a method for determining the additional injected quantity by multiplying a load-dependent wall-film quantity, read from a characteristic curve at the time of activation, by a correction factor. This correction factor is modulated up, during the coasting deactivation time until reactivation, with a first time constant. After reactivation, the previously calculated additional injected quantity is modulated back down with a second time constant.

Improved emissions and fuel consumption value result from deriving the additional injected quantity upon reactivation from a current value for the wall-film quantity.

BRIEF DESCRIPTION OF THE DRAWINGS

The Figure shows a block diagram for a method for determining an additional injected quantity upon reactivating of an internal combustion engine.

DETAILED DESCRIPTION

Cylinder-selective injection suppression is usually performed, for example, with automatic slip control (ASR), during coasting, and in the case of engine speed or vehicle speed limiting. If rotation speed falls below a minimum threshold, or if the throttle is opened, the transition occurs from coasting deactivation (i.e. from injection suppression of individual cylinders) to cylinder-selective reactivation. The sequence of cylinders to be reactivated and their number can be defined by way of specific suppression patterns. If the change in throttle valve angle or rotation speed is small, a staged (soft) reactivation occurs; in the event of large changes in throttle valve angle or rotation speed, reactivation is abrupt (hard). During reactivation, a cylinder-selective additional fuel quantity is required in order to build back up the wall film in the air intake duct that was degraded during suppression, which can be of different durations for the individual cylinders.

The Figure depicts a block diagram which illustrates how the additional injected quantity necessary upon reactivation is determined for a cylinder. Block 1 contains a characteristic curve for the load-dependent wall-film quantity in the air intake duct. From this characteristic curve, the particular present value of the wall-film quantity is read off as a function of the load signal t1. At node 2, a value WOFF, which indicates the minimum wall film at idle, is added to the wall-film quantity WF(k) (ki is a time index) taken from characteristic curve 1. This value WOFF is taken from a characteristic curve 3 dependent on engine speed n, or from a characteristics diagram dependent on engine speed and engine temperature. This minimum wall-film quantity WOFF can, however, also be taken into account in characteristics diagram 1.

A sample-and-hold circuit in block 4 retains that value of the wall-film quantity WFM1=WF(k)+WOFF that is present when a reactivation signal B-WE appears at block 4. This sampled wall-film quantity value WFM1S is conveyed to a further node 5, where it is multiplied by a correction factor fwe. This correction factor fwe is formed in a block 6. If a coasting deactivation signal B-SA is present, a time constant ZFSA is switched through via switch 7 to block 6, which forms the correction factor fwe. The correction factor fwe is then modulated up, with the time constant ZFSA, from a minimum value 0 to a maximum value 1. As soon as a reactivation signal B-WE is present, the sample value for the wall-film quantity WFM1S is multiplied by that value of the correction factor fwe to which the correction factor in block 6 had been modulated up at the time of reactivation. The product of this correction factor fwe times the sampled value of the load-dependent wall-film quantity WFM1S then corresponds to the additional injected quantity tewe.

After reactivation, the additional injected quantity tewe just determined is modulated back down with a time constant ZFWE. Specifically, as soon as the reactivation signal B-WE is present, switch 7 is switched over to this time constant ZFWE, and the factor fwe is modulated down with the time constant ZFWE. Multiplying this down-modulated factor fwe by the wall-film quantity WFM1S sampled at the time of reactivation causes down-modulation of the additional injected quantity tewe.

The two time constants ZFSA and ZFWE are defined as a function of the load, the engine speed, or other suitable engine variables.

The additional injected quantity tewe is calculated individually for each cylinder at the time of reactivation. This is necessary in particular in the case of staged reactivation, since individual cylinders are then not activated until later, when a different load is present. This also results, for each cylinder, in the wall-film quantities that are modified in accordance with this differing load.

The signal tewe for the additional injected quantity for each individual cylinder is overlaid at a node on a signal te, derived from the load signal t1, for the basic injected quantity for each individual cylinder. A correction signal TVUB, which takes into account an energizing delay (which depends on battery voltage) in the injection valves for the individual cylinders, can also be overlaid at node 9 on the signal te for the basic injected quantity. It is also advantageous to overlay on the signal te for the basic injected quantity, at a further node 10, a correction signal teukg which globally (and not on a cylinder-selective basis) takes into account wall-film compensation with rising or falling load (transition compensation). This global transition compensation signal teukg is made up of three components, namely a K component, an L component, and a W component. The K and L components, overlaid on one another at node 11, are derived from the change over time in the load-dependent wall-film quantity WF(k). Short-term changes in the wall-film quantity are accumulated as the K component in a first memory 12, and long-term changes as the L component in a second memory 13. The distinction between the two components depends on the engine speed and the direction of the load change. The change in wall-film quantity is determined with the aid of a delay element 14 which makes available, at a node 15, a value WF(k-1) for the wall-film quantity delayed by one time unit. Node 15 constitutes the difference between the k-th and the (k-1)-th value of the wall-film quantity, which yields the changes in the wall-film quantity. The W component of the transition compensation signal is formed in a third memory 16 which accumulates (for example on a 10-ms cycle) changes in a secondary load signal t1w that depends on throttle valve position and engine speed. This W component is added to the K and L components at a node 17.

The transition compensation signal teukg can also be determined in a manner deviating from the method described above.

From the signal te for the basic injected quantity, acted upon by the correction signals teukg, tewe, and TVUB, there ultimately results the desired signal ti for the injected quantity for each individual cylinder.

If a coasting deactivation occurs during a down-modulation of injected quantity ti, the down-modulation operation is discontinued and the signal ti is set to zero by means of a switch 18 controlled by the coasting deactivation signal B-SA.

What is claimed is:

1. A method for determining an additional quantity of fuel to be injected upon a reactivation of at least one suppressed cylinder of an internal combustion engine, comprising the steps of:

determining a load-dependent wall-film quantity at a time of activation;

modulating a correction factor, the correction factor being modulated up, during a coasting deactivation time until the reactivation, with a first time constant, and being modulated down during the reactivation with a second time constant; and multiplying the load-dependent wall-film quantity by the correction factor to determine the additional quantity of fuel.

2. The method according to claim 1, wherein the first and second time constants are load-dependent.

3. The method according to claim 1, wherein the first and second time constants are engine speed dependent.

4. The method according to claim 1, wherein the additional quantity of fuel is set to a value of 0 if a coasting deactivation occurs during a downward modulation of the correction factor.

5. The method according to claim 1, wherein the load-dependent wall-film quantity is determined from a characteristic curve.

* * * * *